US008167624B2

(12) United States Patent
Hartlef et al.

(10) Patent No.: US 8,167,624 B2
(45) Date of Patent: May 1, 2012

(54) FASTENING SYSTEM FOR FASTENING A CABIN FITTING ELEMENT TO A SUPPORT STRUCTURE OF AN AIRCRAFT

(75) Inventors: Matthias Hartlef, Stade (DE); Frank Cordes, Stade (DE)

(73) Assignee: Airbus Operations GmbH, Hamburg (DE)

( * ) Notice: Subject to any disclaimer, the term of this patent is extended or adjusted under 35 U.S.C. 154(b) by 196 days.

(21) Appl. No.: 12/281,524

(22) PCT Filed: Mar. 16, 2007

(86) PCT No.: PCT/EP2007/052500
§ 371 (c)(1),
(2), (4) Date: Dec. 12, 2008

(87) PCT Pub. No.: WO2007/107511
PCT Pub. Date: Sep. 27, 2007

(65) Prior Publication Data

US 2009/0221154 A1 Sep. 3, 2009

(30) Foreign Application Priority Data

Mar. 17, 2006 (DE) ..... 10 2006 012 730

(51) Int. Cl.
*H01R 13/361* (2006.01)

(52) U.S. Cl. ..... 439/39

(58) Field of Classification Search ..... 439/39, 439/248, 247, 158, 556; 29/825, 856
See application file for complete search history.

(56) References Cited

U.S. PATENT DOCUMENTS

| | | | | |
|---|---|---|---|---|
| 3,810,258 | A * | 5/1974 | Mathauser | 439/39 |
| 3,951,500 | A * | 4/1976 | Anderson | 439/248 |
| 4,289,368 | A * | 9/1981 | Schildkraut | 439/320 |
| 4,950,174 | A * | 8/1990 | Llewellin et al. | 439/158 |
| 5,225,816 | A * | 7/1993 | Lebby et al. | 340/653 |
| 5,667,398 | A | 9/1997 | Kidd et al. | |

(Continued)

FOREIGN PATENT DOCUMENTS

DE 3536142 C2 4/1987

(Continued)

OTHER PUBLICATIONS

International Search Report dated Jun. 6, 2007.

(Continued)

*Primary Examiner* — Alexander Gilman
(74) *Attorney, Agent, or Firm* — Perman & Green, LLP

(57) ABSTRACT

A fastening system for fastening a cabin fitting element with at least one electrical installation on a support structure of an aircraft. During installation into the support structure, the cabin fitting element is fixed in succession by at least one loose bearing in at least one degree of translational freedom and then by at least one fixed bearing in the at least one further degree of translational freedom. In order to ensure an improved installation and dismantling of cabin covering panels with electrical installation and to reduce the weight due to the components and also the installation space which is required, according to the disclosed embodiments a contact device with a bush arrangement and a plug arrangement is integrated in the at least one loose bearing and/or the at least one fixed bearing, by which an electrical connection is produced between the support structure and the electrical installation of the cabin fitting element on fixing at least of one degree of translational freedom.

10 Claims, 6 Drawing Sheets

U.S. PATENT DOCUMENTS

| | | | | |
|---|---|---|---|---|
| 6,361,357 | B1 * | 3/2002 | Stillwell et al. | 439/490 |
| 6,641,325 | B2 | 11/2003 | Schwarz | |
| 6,752,655 | B1 * | 6/2004 | Kaczmarek | 439/546 |

FOREIGN PATENT DOCUMENTS

| | | | |
|---|---|---|---|
| DE | 8530786 | U1 | 2/1989 |
| DE | 20016889 | U1 | 12/2000 |
| EP | 0893856 | A | 1/1999 |
| EP | 1403979 | A | 3/2004 |
| EP | 0797274 | A2 | 9/2008 |
| GB | 1198775 | A | 7/1970 |

OTHER PUBLICATIONS

German Examination Report dated Mar. 17, 2006.

* cited by examiner

FASTENING SYSTEM FOR FASTENING A CABIN FITTING ELEMENT TO A SUPPORT STRUCTURE OF AN AIRCRAFT

CROSS REFERENCE TO RELATED APPLICATIONS

This application is the National Stage of International Application No. PCT/EP2007/052500, International Filing Date, 16 Mar. 2007, which designated the United States of America, and which International Application was published under PCT Article 21 (2) as WO Publication No. WO2007/107511 and which claims priority from German Application No. 102006012730.7, filed on 17 Mar. 2006, the disclosures of which are incorporated herein by reference in their entireties.

BACKGROUND

1. Field

The disclosed embodiments relate to a fastening system for fastening a cabin fitting element to a support structure of an aircraft. Particularly, but not exclusively, the disclosed embodiments refer to cabin fitting elements having at least one electrical installation.

2. Brief Description of Related Developments

The interior lining of aircraft is generally composed of individual elements, in which substantially plates or panels are placed adjacent to each other in a given framework or support structure. These plates serve for example as roof- or side covering. During maintenance work, these covering plates must be able to be removed again individually and without great effort, for example in order to be able to carry out maintenance work behind the plates, i.e. between the outer skin of the aircraft and the interior lining, and they must then be able to be inserted again without difficulty. In the case of panels with incorporated electrical components, this means that one has to open up and close again both the mechanical connection and also the electrical connection of the panels with each other or with the support structure. In the current cabin fitting parts which have been mentioned, separate mechanical and electrical connectors are provided for this. Thus, for example, roof wall panels are secured by means of three or four mechanical fastening elements, two of which are constructed as loose bearings and one or two as fixed bearings. The electrical connection of such a roof wall panel is usually produced by means of a plug connection, in which one plug is fixedly installed on the panel and one plug is loosely mounted on the support structure of the aircraft.

In order to keep the mechanical stress of the electrical plug connection low and hence to avoid damage to the electrical connection when the panel is loosened and removed from its support structure, check cables must be additionally provided in the prior art, which hold the panel which has been loosened from its anchoring in suspension, until the electrical plug connection is produced or separated independently of the mechanical anchoring of the two parts. Accordingly, in the reverse operation, namely when installing the panels, the check cables also constitute a facilitating of the operation.

In order to ensure a suitable play during the letting down of the panel for installation/dismantling, depending on the length of the check cables, the electrical cables in this prior art must be installed with an excess length. The result of this is that material has to be used which is only required for assembly. Therefore, the weight of the aircraft is increased unnecessarily. Furthermore, the over-long cables are not fixed, and they can move in an uncontrolled manner with the movements of the aircraft, which may lead to noise and to damage to the cables through friction.

SUMMARY

In one aspect the disclosed embodiments are directed to an improved installation and dismantling of cabin covering panels having an electrical fitting, and to reduce the weight necessitated by components and also to reduce the required installation space.

In FIG. 1 a portion of a panel 1 is shown as a cabin fitting element, which is connected mechanically and electrically with a support structure 2 of the aircraft. Generally, such panels are connected with the respective support structure of the aircraft by means of one or more loose bearings and one or more fixed bearings. The fixed bearings define the position of the panel in the support structure, i.e. in the aircraft, whilst mechanical tolerances and dynamic changes in position, which are caused for example by fluctuations in temperature or by vibrations, can be balanced out by means of the loose bearings. In order to support the panel during installation and dismantling up to final fastening, in addition an intermediate mounting is provided. Through the connection of the panel with the support structure by means of the loose bearing, the panel is arrested in at least one degree of translational freedom. The panel is only fixed with respect to the other degrees of freedom in a second stage. The fastening in two stages provides the possibility of further aligning the panel in relation to the other degrees of translational freedom and especially of also carrying out further connecting operations, such as for example the production of electrical contacts which are no longer able to be carried out after the final fastening of the panel on the support structure, because some of the components are then no longer accessible.

The panel according to FIG. 1 is held on one side by a loose bearing which has a mounting device and an anchoring device. This loose bearing is described further below. On another side, the panel will be arrested by a fixed bearing 3 in its final position on the support structure 2 of the aircraft. The fixed bearing 3 according to this prior art consists of a connecting pin 4 with a locking groove or a locking channel 4*a* on the side of panel 1 and with a passage opening 5 and a connecting clip 5*a* on the side of support structure 2. On connection of the fixed bearing 3, the connecting clip 5*a* engages on the support side in the locking channel 4*a* and thus fixes the panel 1 on the support structure 2.

Before the fixed panel 3 is closed and the panel 1 is fixed in its final position on the support structure 2, the panel 1 is held loosely by means of a check cable 6 on the support structure 2 of the aircraft, so that an intermediate space still exists in order to be able to produce the electrical plug connection between the panel 1 and the support structure 2. The check cable 6 is connected with the support structure 2 by means of a connection 7, and with the panel 1 by means of a connection 8. These connections 7 and 8 of the check cable 6 may be permanent, or may be produced from case to case.

The temporary connection of panel 1 with the support structure 2 by means of the check cable 6 allows the electrical connection of a cable 9 on the support side with a cable 10 on the panel side by means of a plug contact with the two elements 11 and 12. In so doing, in the prior art which is shown, the plug contact element 12 is connected with the cable 9 on the support side and hangs loosely from the support structure 2, the cable 9 being so long that a sufficient play exists for installation. The plug contact element 11 on the panel side, on the other hand, is securely connected with the panel 1. The plug contact element 12 is therefore inserted into the plug contact element 11 or is removed therefrom, as indicated by a double arrow. Thus, the contact element 12 can be connected with the contact element 11 between the fixing of the panel 1 by means of the loose bearing and the fixing by means of the fixed bearing 3. The fixed bearing 3 is then engaged and the panel is in its final position, and the electrical contacts are connected. It is obvious to the skilled person that the coordination of fixedly connected cable and loose cable on the one hand, and support structure and cabin fitting element on the other hand, can also be selected differently from in the embodiment which is shown here.

As indicated above, the panel 1 is held on one side by a loose bearing 13 into which it is suspended before it is finally fixed by the fixed bearing 3. The loose bearing 13 consists of a mounting device 14 and an anchoring device 15. The mounting device 14 is situated on the side of the support structure 2 and consists substantially of a funnel-shaped arrangement which may have the shape of a truncated cone or truncated pyramid, in which its width of opening and angle of opening may be different for each direction. The anchoring device 15 is situated on the side of the panel 1 and consists substantially of a thickening which is pressed into the mounting device 14. It is clear to the skilled person that the coordination of the mounting device 14 on the one hand and the anchoring device 15 on the other hand may also be selected differently from in the embodiment shown here.

The loose bearing 13 only fixes one or two of the degrees of translational freedom. In FIG. 1, the degrees of translational freedom are fixed by the loose bearing upward in FIG. 1 and also perpendicularly to the plane of the drawing. This is indicated in FIG. 1 by the straight double arrow on the loose bearing 13. The degree of freedom in FIG. 1 from right to left is only fixed by the fixed bearing 3. Rotary movements are possible independently of the degrees of translational freedom; this is indicated in FIG. 1 by the bent double arrow.

The fastening of the panel in this prior art makes two different working steps necessary, namely on the one hand the mechanical fastening of panel and support structure, and on the other hand the electrical connection of panel and support structure. Furthermore, an intermediate connection in the manner of a check cable 6 is necessary.

The disclosed embodiments are based on the idea of integrating the required electrical contacts into at least one of the mechanical bearings, so that during coupling-in either into the loose bearing or into the fixed bearing, an electrical connection is produced having several contacts between the support structure and the installation element.

The fastening system according to the disclosed embodiments, for fastening a cabin fitting element having at least one electrical installation to a support structure of an aircraft, in which the cabin fitting element is fixed during installation into the support structure in succession by at least one loose bearing in at least one degree of translational freedom and then by at least one fixed bearing in the at least one further degree of translational freedom, is characterized in that a contact device having a bush arrangement and a plug arrangement is integrated in the at least one loose bearing and/or in the at least one fixed bearing, through which an electrical connection is produced between the support structure and the electrical installation of the cabin fitting element during fixing of at least one degree of translational freedom.

In particular, preferred embodiments have one or—in so far as is technically suitable and possible—several of the following features:

the bush arrangement and/or plug arrangement is rotatable in the bearing about at least one axis which is perpendicular to the direction of insertion;

the bush arrangement and/or plug arrangement is displaceable in the plugging direction between a first and a second stop in the bearing;

the bush arrangement and the plug arrangement are aligned to each other automatically by a conically tapering guide opening and a complementary acutely tapering guide pin during the fixing of a degree of translational freedom;

the bush arrangement and the plug arrangement are aligned to each other automatically by a complementary, substantially conically tapering outer shape during the fixing of the degree of translational freedom;

the fixed bearing comprises a connecting pin and a passage opening, to which respectively a bush arrangement and a plug arrangement are symmetrically arranged, so that the bush arrangement and the plug arrangement produce an electrical connection, when the fixed bearing is assembled;

the bush arrangement and/or the plug arrangement is rotatable about its axis of symmetry and alignment aids are provided by which the bush arrangement and the plug arrangement are automatically aligned to each other whilst the halves of the bearing are guided up to each other;

a visible and/or acoustic signal is generated when the bush arrangement and the plug arrangement have been connected with each other;

a mechanical detent mechanism is provided for the permanent connection of the bush arrangement and the plug arrangement;

a magnetic closure system is provided for the permanent connection of the bush arrangement and the plug arrangement.

The disclosed embodiments therefore have the advantage, inter alia, that a defined cable guide is secured in the case of an installed panel, so that movements of the cable are thereby avoided, because excess lengths of cable are no longer necessary for installation.

Further advantages and features of the disclosed embodiments will be apparent from the following description of preferred example embodiments in which reference is made to the enclosed drawings.

DETAILED DESCRIPTION

In accordance with the disclosed embodiments, on the other hand, a loose bearing or fixed bearing with an integrated contact device is created. This is explained below with reference to FIGS. 2 to 6.

Figure 1:
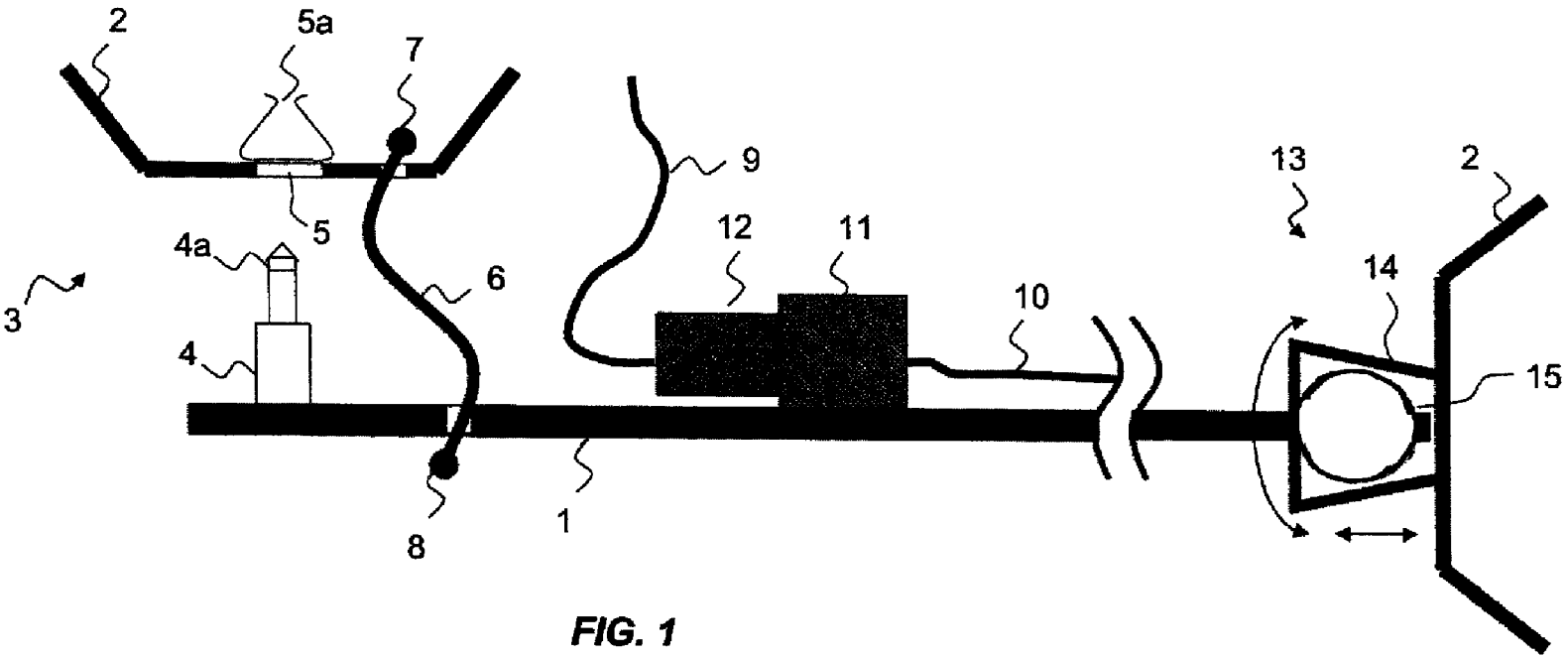
FIG. 1 PRIOR ART
FIG. 1 shows a mechanical connection of panel and support element with an electrical contact device, independent thereof, according to the prior art.
Figure 2A:
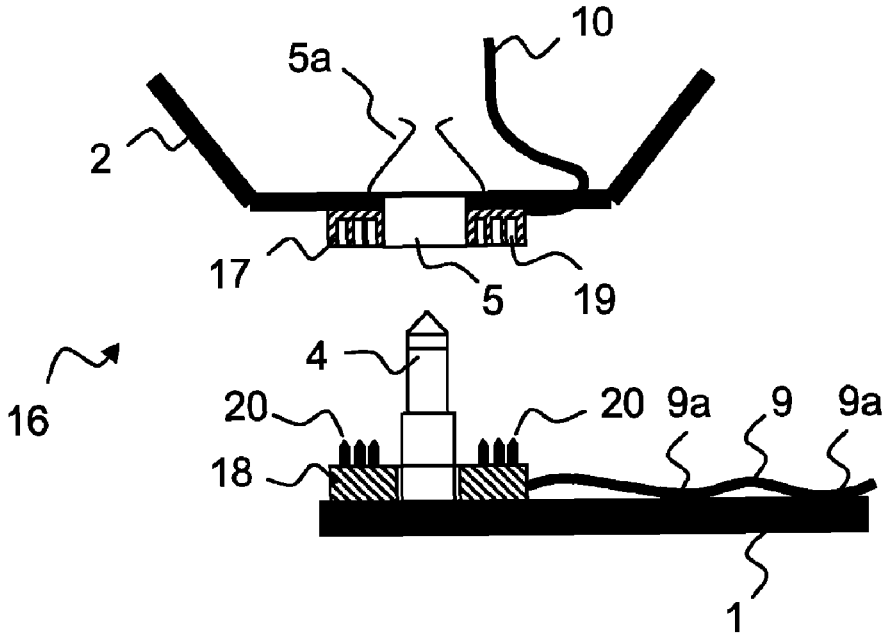
FIGS. 2A and 2B show an embodiment of the fixed bearing according to the disclosed embodiments, with an integrated electrical contact device in separated and assembled states.
Figure 2B:
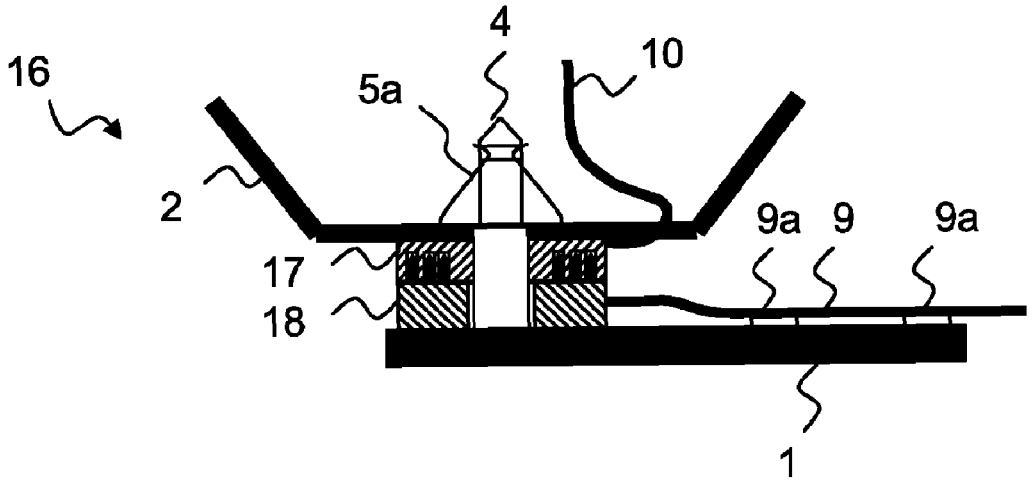

In FIGS. 2A and 2B an embodiment is shown, in which the contact elements are integrated in a fixed bearing. The fixed bearing 16 according to FIGS. 2A and 2B has the same structure mechanically as the fixed bearing 3 according to FIG. 1 which is shown as an example of the prior art. However, differently from the prior art, in the fixed bearing 16 according to the disclosed embodiments, a bush arrangement 17 is mounted on the support structure 2 side centrally to the passage opening 5 for the connecting pin 4, said bush arrangement 17 being arranged in particular symmetrically with respect to the passage opening 5. In the illustrated embodiment, the bush arrangement 17 has a series of individual bushes 19 on the support structure 2.

On the side of the cabin fitting element 1 which is to be installed, a complementary plug arrangement 18 is situated, which is provided with individual plugs 20 which, in turn, are complementary to the individual bushes 19. The plug arrangement 18 is likewise arranged symmetrically to the connecting pin 4. An electric cable 10 leads from the bush arrangement 17 on the support 2 side to a supply- or data processing unit (not illustrated). A cable 9 for the supply of the electrical installation (not shown) is mounted on the panel 1 by the plug arrangement 18 on the side of the panel 1, said cable being connected securely with the panel in particular by cable clips 9*a*, so that it does not come between the two bearing halves during the assembly of the fixed bearing 16 and does not make uncontrolled movements during the flight.

In FIG. 2A the fixed bearing is shown in separated state. When the bearing is being assembled, the connecting pin 4 with the connecting channel 4*a* is inserted through the passage opening 5 of the support 2 and becomes locked with the connecting clip 5*a*. In FIG. 2B the fixed bearing is shown in the assembled state. As can be seen there, during the assembly of the fixed bearing 16, the electrical connection is automatically produced between the panel 1 and the support 2. When the panel 1 is being brought up to the support, the pins 20 catch into the bushes 19 and thus ensure the electrical contact between the cable 9 on the panel 1 and the cable 10 on the support 2. In order to ensure the correct alignment of the bush arrangement 17 and the plug arrangement 18, at least one of the two contact arrangements 17, 18 can be rotatable about its axis of symmetry (i.e. the connecting pin 4 or the passage opening 5). For this, alignment aids (not shown) in the manner of a bayonet- or screw closure can be provided, so that the two contact arrangements 17, 18 automatically align themselves to each other whilst the bearing halves are being brought together.

Figure 3:
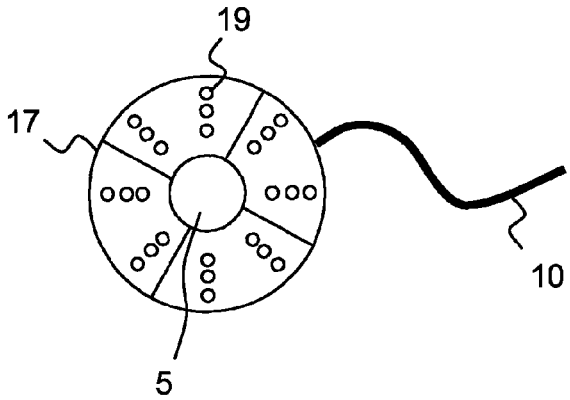
FIG. 3 shows an element of the embodiment of the fixed bearing according to the disclosed embodiments in accordance with FIG. 2 in top view.

The bush arrangement 17 with the individual bushes 19 is shown in top view in FIG. 3. It can be seen from FIG. 3 that the distribution of the individual bushes in the contact arrangement 17 is basically random, and depending on requirements a dense coverage with individual bushes or a less dense coverage can be selected. However, this is to be symmetrical, as shown, in relation to the passage opening 5, so that a provisional alignment of the two contact arrangements 17, 18 is simply and readily possible and a contact is produced when the contact arrangements move toward each other.

It can be seen directly that the assembly of the bearing and the production of electrical contacts is made possible in a single working step, which means saving time in the production of an aircraft and in its maintenance. In addition, intermediate mountings such as check cables, which are only required for the installing, are eliminated, so that in addition weight can be saved with the fastening system according to the disclosed embodiments.

Figure 4:
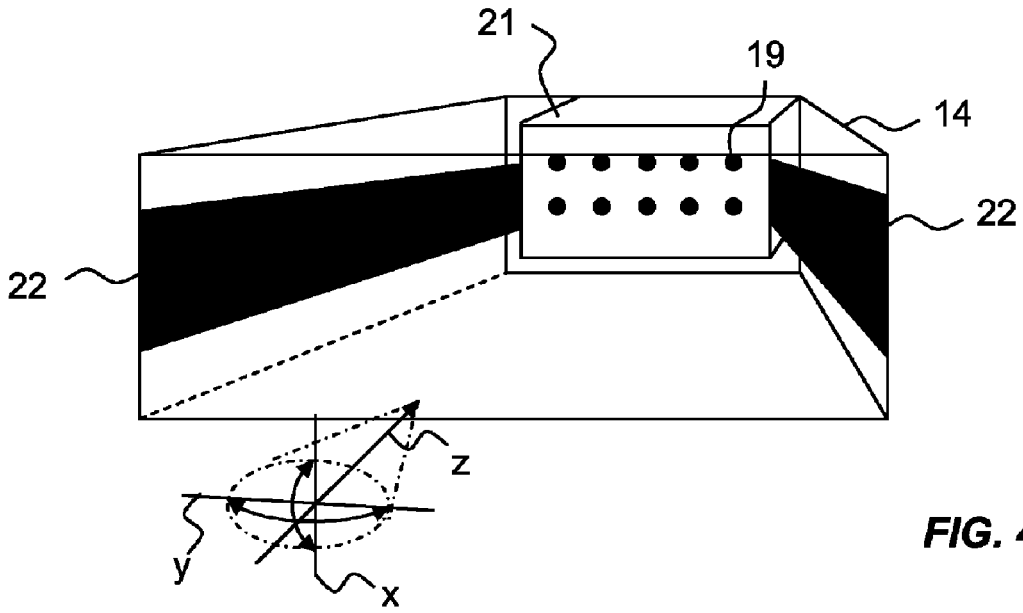
FIG. 4 shows an embodiment of the electrical contact device according to the disclosed embodiments, for a loose bearing.

An alternative embodiment of the fastening system according to the disclosed embodiments with integrated contact arrangement is shown in FIG. 4. FIG. 4 shows a bush arrangement 21 according to the disclosed embodiments, with individual bushes 19 for the mounting device of a loose bearing 14. In the embodiment which is shown, the mounting device 14 has a given cross-section at its inlet, which reduces with increasing depth. The direction of insertion of a plug part (not illustrated) is designated by "z" in FIG. 4. Owing to the larger cross-section at the inlet of the mounting device 14, the plug part (not shown) has a certain play in the "x" and "y" directions, i.e. perpendicularly to the plug direction "z". As the depth of insertion of the plug part (not shown) increases, its play decreases, so that the plug part is finally fixed in the "x" and "y" directions and only has a degree of freedom in the "z" direction. This is indicated in FIG. 4 by a cone around the direction of insertion "z". To improve the sliding properties of the plug part (not shown) the mounting device 14 comprises an alignment spring 22 which is provided on at least two sides of the mounting device 14. This alignment spring 22 can run in a straight line as illustrated, but it may equally well be slightly curved, so that its aligning effect is of greater or lesser intensity depending on the depth of penetration. In this embodiment, the plug part is held by the alignment spring 22 and is centred between its two side elements. Here, instead of only one alignment spring 22 to the left and right in the mounting device 14, further alignment springs can also be provided, for example above and below in the mounting device 14.

Alternatively, the centering and aligning of the bush arrangement and plug arrangement can also take place by means of a central guide pin and a central guide opening. One embodiment of this type is explained below with reference to FIGS. 5 and 6.

Figure 5:
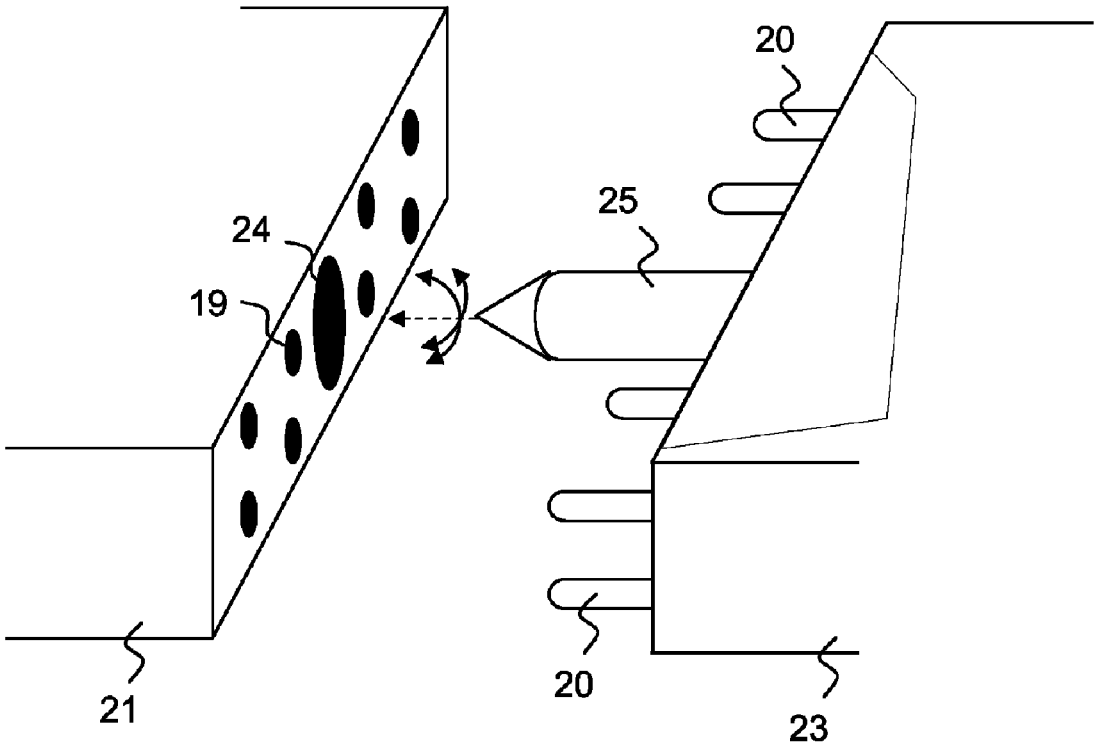
FIG. 5 shows a further embodiment of the electrical contact device according to the disclosed embodiments, for a loose bearing.

In FIG. 5 a corresponding bush arrangement 21 with individual bushes 19 and a plug arrangement 23 with individual plugs 20 are shown. The bush arrangement 21 has a guide opening 24—preferably centrally. A corresponding guide pin 25 on the plug arrangement 23 side engages into this guide opening 24 so that the plugs 20 of the plug arrangement 23 and the bushes 19 of the bush arrangement 21 are aligned accordingly. The guide pin 25 is preferably substantially longer than the actual individual plugs 20, so that it reaches the guide opening 24 before one of the individual plugs 20 reaches one of the individual bushes 19. In this way, the individual bushes 19 and individual plugs 20 are prevented from being exposed to mechanical stresses. The initial play of the plug arrangement 23 with respect to the bush arrangement 21 is indicated by the crossed double arrows and the dashed axis of symmetry.

To widen the angle at which the two contact arrangements 21 and 23 can be moved towards each other, the guide pin 25 is shaped conically at its tip so that it can also be introduced at an unfavourable angle into the guide opening 24 of the contact arrangement 21. As the two contact arrangements continue to draw near to each other, the individual contacts 19 and 20 automatically align themselves to each other.

As already mentioned, the contact arrangement 21 is arranged for example in a mounting device 14 of a loose bearing. In an analogous manner, the contact arrangement 23 is then arranged in an anchoring device 15. In a preferred embodiment, at least one of the contact arrangements 21, 23 is rotatable perpendicularly to the insertion direction "z". Particularly preferably, the contact arrangements are rotatable about two axes perpendicularly to the insertion direction. The maximum angle of rotation here may be up to 90° and depends substantially on the pre-alignment of the contact arrangements by the mechanical bearing. The contact elements are therefore to a certain extent independent of the mechanical bearings, and a certain mobility of the contact arrangements is ensured in the production of the electrical connection.

Figure 6:
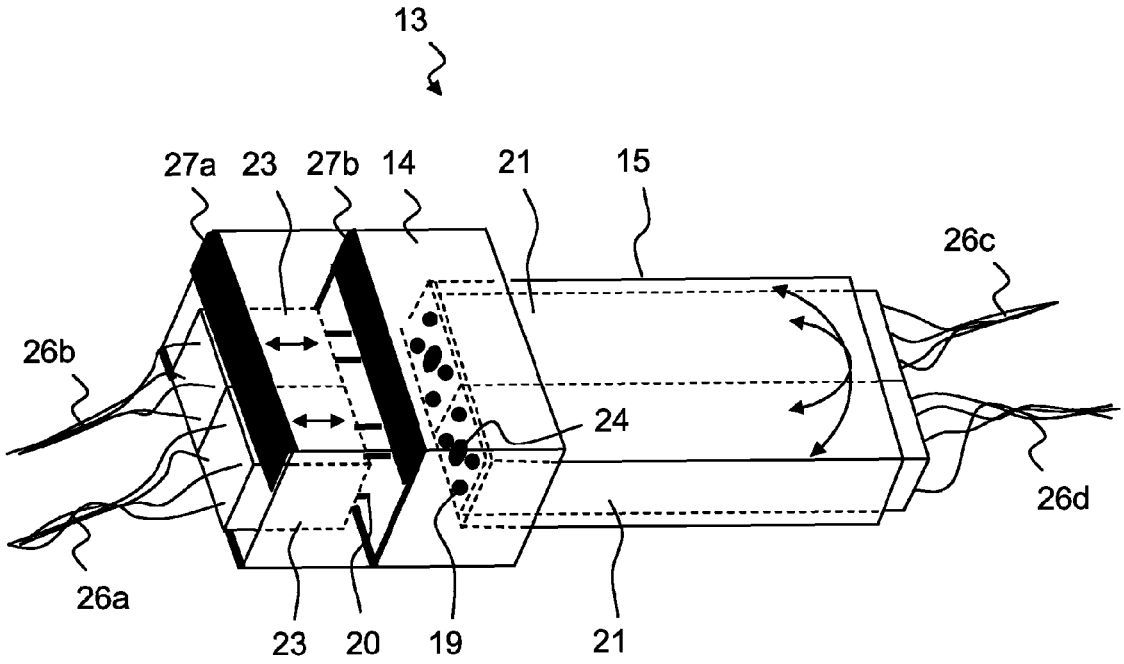
FIG. 6 shows an embodiment of the loose bearing according to the disclosed embodiments in accordance with FIG. 5 in assembled state.

The loose bearing with the integrated contact arrangements 21 and 23 is illustrated in the assembled state in FIG. 6. Here, the loose bearing 13 comprises a mounting device 14 with two integrated plug arrangements 23 and an anchoring device 15 with two integrated bush arrangements 21. The anchoring device 15 with the two integrated bush arrangements 21 is introduced into the mounting device 14 with the two plug arrangements 23. In the production of the electrical contact, the guide pin 25 and the guide opening 24 align the two arrangements 21, 23 to each other. The contact arrangements 21 and respectively 23 are connected on their rear side respectively with a cable 26, in which in the illustrated embodiment the cables 26*a*, 26*b*, 26*c* and 26*d* for the contact arrangements 21 and 23 respectively comprise four individual leads. Other distributions of the leads onto the contact elements are, of course, equally conceivable.

The play of the loose bearing shown in FIG. 5 is defined according to the length of the region of the anchoring device 15 which is covered by the mounting device 14, said play being indicated by the two bent double arrows.

In the embodiment shown in FIG. 6, the plug arrangement 23 is arranged in the mounting device 14 between two stops 27*a* and 27*b*. These stops 27*a*, 27*b* define a region within which the plug arrangement 23 is displaceable. The plug arrangement 23 is therefore pressed backwards during the assembly of the bearing 13, and only when it is prevented by the rear stop 27*a* from retreating further do the individual plugs 20 penetrate into the individual bushes 19 and form an electrically reliable contact. Vice versa, on loosening of the bearing 13, the plug arrangement 23 with the bush arrangement 21 also moves a distance further, and only when it is prevented by the front stop 27*b* from following further are the individual plugs 20 drawn out from the individual bushes 19. Through this "hysteresis" during installation and dismantling, it is achieved that the electrical connection is brought about really reliably and does not become disconnected for example in the case of vibrations through flight operations.

Figure 7A:
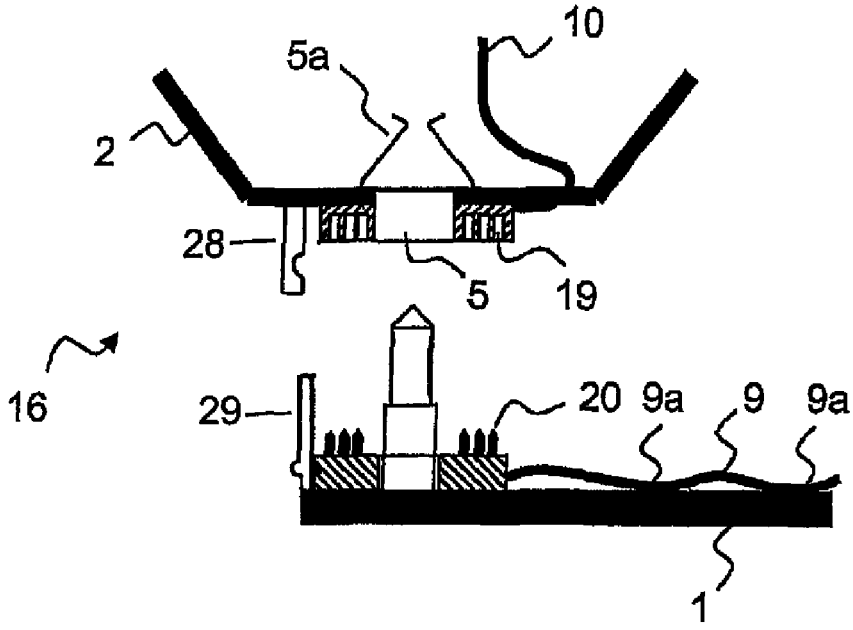
FIGS. 7A and 7B show an embodiment where mechanical locking and electrical contact are indicated by a visible or acoustic signal.
Figure 7B:
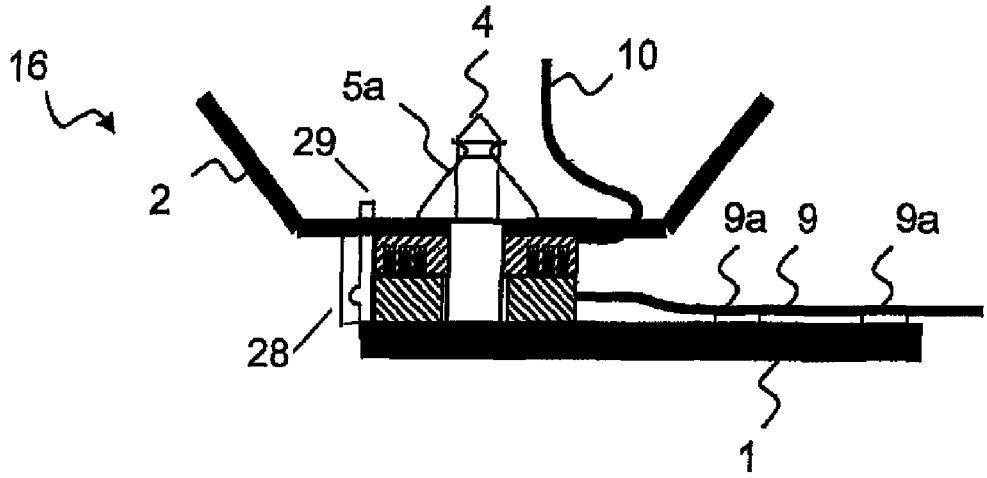
Figure 8A:
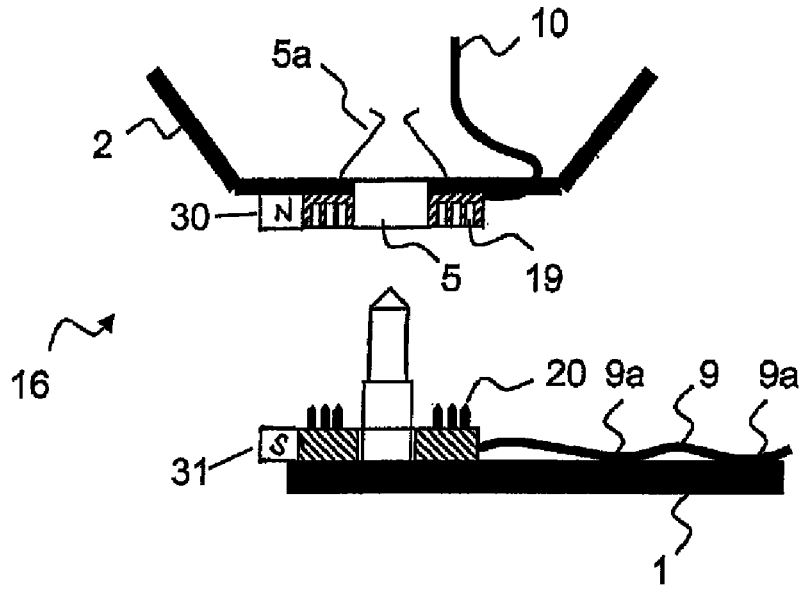
FIGS. 8A and 8B show an embodiment with a magnetic closure system.
Figure 8B:
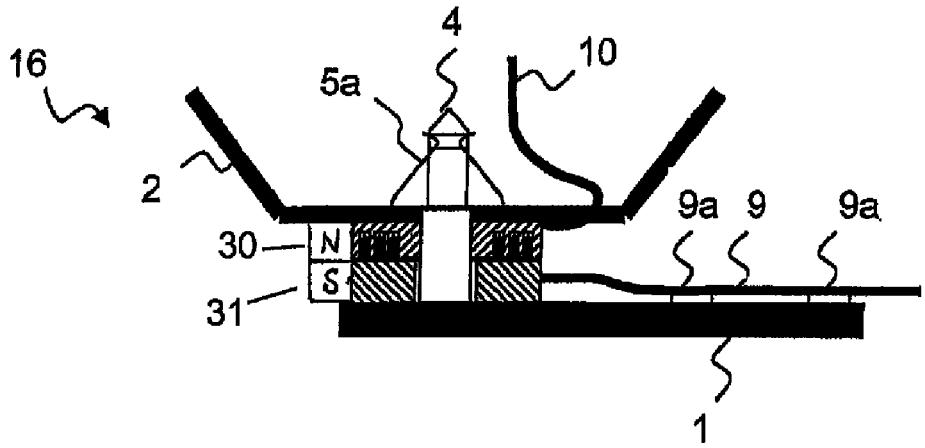

However, the disclosed embodiments are not restricted to the embodiments described above. In a preferred embodiment, which is not shown, the mechanical locking and particularly the production of the electrical contact are indicated by a visible or an acoustic signal. Thus, a finger of plastic 29 (FIGS. 7A, 7B) can project from an opening in the panel 1 or in the support structure 2, which only becomes visible when the contact between the panel 1 and the support structure 2 has been produced as specified. This can be accompanied by an audible engagement which is possibly further augmented by the snapping-in of additional plastic tongues 28. The plastic tongues 28, 29 are preferably shaped so that they constitute a small, surmountable resistance during locking and unlocking. Alternatively, apart from for acoustic signalling, the plastic tongues 28, 29 can also be used as a mechanical detent mechanism which is provided for the permanent connection of the contact device. Further aids may also be used to stabilize the connection, such as for example a magnetic closure system 30, 31 (FIGS. 8A, 8B) for the permanent connection of the contact device.

It is obvious to the skilled person that in the described embodiments the electrical components plugs and bushes can likewise be exchanged, and also the mechanical components mounting- and anchoring devices, unless this is explicitly excluded.

REFERENCE NUMBERS

1 cabin fitting element
2 support structure
3 fixed bearing
4 connecting pin, 4*a* locking channel
5 passage opening, 5*a* connecting clip
6 check cable
7 first anchoring of check cable
8 second anchoring of check cable
9 cable on structure side, 9*a* cable clips
10 cable on support side
11 plug contact on structure side
12 (loose) plug contact on support side
13 loose bearing
14 loose bearing, mounting device
15 loose bearing, anchoring device
16 loose bearing with contact device
17 bush arrangement for fixed bearing
18 plug arrangement for fixed bearing
19 individual bush, hollow guide
20 individual plug, pin
21 bush arrangement for loose bearing
22 alignment spring
23 plug arrangement for loose bearing
24 guide opening in bush arrangement for loose bearing
25 guide pin
26 wiring harness, 26*a* -26*d*
27 detent, 27*a* detent rear, 27*b* detent front
x,y,z degrees of translational freedom

The invention claimed is:

1. A fastening system for fastening a cabin fitting element with at least one electrical installation on a support structure of an aircraft, in which the cabin fitting element on installation into the support structure is fixed in succession by at least one loose bearing in at least one degree of translational freedom and then by at least one fixed bearing in the at least one further degree of translational freedom, wherein a contact device with a bush arrangement and a plug arrangement is integrated in the at least one loose bearing, by which an electrical connection is produced between the support structure and the electrical installation of the cabin fitting element during the fixing of at least of one degree of translational freedom and the bush arrangement and/or the plug arrangement is displaceable in the insertion direction between a first and a second stop in the loose bearing.

2. The fastening system according to claim 1, further comprising that the bush arrangement and/or the plug arrangement is rotatable about at least one axis, standing perpendicular to the insertion direction, in the bearing.

3. The fastening system according to claim 1, further comprising that the bush arrangement and/or the plug arrangement is displaceable in the insertion direction between a first and a second stop in the bearing.

4. The fastening system according to claim 2, further comprising that the bush arrangement and the plug arrangement are automatically aligned to each other by a conically tapering guide opening and a complementary acutely tapering guide pin on fixing a degree of translational freedom.

5. The fastening device according to claim 2, further comprising that the bush arrangement and the plug arrangement are automatically aligned to each other by a complementary, substantially conically tapering outer shape on fixing a degree of translational freedom.

6. The fastening system according to claim 1, wherein the fixed bearing comprises a connecting pin and a passage opening to which respectively a second bush arrangement and a second plug arrangement is symmetrically arranged, so that the second bush arrangement and the second plug arrangement produce an electrical connection when the fixed bearing is assembled.

7. The fastening system according to claim 6, further comprising that the second bush arrangement and/or the second plug arrangement is rotatable about its axis of symmetry and alignment aids are provided, by which the second bush arrangement and the second plug arrangement are automatically aligned to each other when bearing halves of the fixed bearing are being brought up to each other.

8. The fastening system according to claim 1, further comprising that a visible and/or acoustic signal is generated when the bush arrangement and the plug arrangement have been connected with each other.

9. The fastening system according to claim 1, further comprising that a mechanical detent mechanism is provided for the permanent connection of the bush arrangement and the plug arrangement.

10. The fastening system according to claim 1, further comprising that a magnetic closure system is provided for the permanent connection of the bush arrangement and the plug arrangement.

* * * * *